US007510432B2

(12) United States Patent
Entsfellner

(10) Patent No.: US 7,510,432 B2
(45) Date of Patent: Mar. 31, 2009

(54) COAXIAL INSERTION CONNECTED CONNECTOR HAVING QUICK ACTION LOCKING MECHANISM

(75) Inventor: Christian Entsfellner, Fridolfing (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 11/692,999

(22) Filed: Mar. 29, 2007

(65) Prior Publication Data

US 2007/0161288 A1 Jul. 12, 2007
US 2009/0053928 A9 Feb. 26, 2009

Related U.S. Application Data

(63) Continuation of application No. PCT/EP2005/010274, filed on Sep. 22, 2005.

(30) Foreign Application Priority Data

Oct. 6, 2004 (DE) ..... 20 2004 015 502 U

(51) Int. Cl.
*H01R 9/05* (2006.01)

(52) U.S. Cl. ..... 439/578

(58) Field of Classification Search ..... 439/578, 439/63, 581, 582, 583, 584, 585
See application file for complete search history.

(56) References Cited

U.S. PATENT DOCUMENTS 3,206,540 A * 9/1965 Cohen ..... 174/89
3,340,495 A 9/1967 Weinschel et al.
3,492,604 A * 1/1970 Fan ..... 333/33
3,976,352 A * 8/1976 Spinner ..... 439/140
4,012,105 A 3/1977 Biddle et al.
4,373,767 A * 2/1983 Cairns ..... 439/275
4,596,435 A * 6/1986 Bickford ..... 439/582
4,824,400 A * 4/1989 Spinner ..... 439/578
4,854,893 A * 8/1989 Morris ..... 439/578
5,556,284 A * 9/1996 Itou et al. ..... 439/34

(Continued)

FOREIGN PATENT DOCUMENTS

EP 1337008 8/2003

(Continued)

*Primary Examiner*—T C Patel
*Assistant Examiner*—Vladimir Imas
(74) *Attorney, Agent, or Firm*—DeLio & Peterson, LLC; Robert Curcio

(57) ABSTRACT

In a co-axial insertion-connected connector having quick-action locking mechanism, designed to receive a complementary insertion-connected connector, the connectors capable of connecting together by a coupling member belonging to the locking mechanism, and each having a center-conductor and an outer-conductor, a contact member being arranged in the co-axial insertion-connected connector such that when the connectors are plugged together, the contact member is arranged between the outer-conductor of the connectors, the arrangement made so that the contact member takes the form of a sleeve, the sleeve making electrical contact to give a contact region at the end-face of the outer-conductor of the complementary co-axial insertion-connected connector and the sleeve making electrical contact with the outer-conductor of the co-axial insertion-connected connector, and in such a way that an elastic length-adjusting member abuts against the outer-conductor of the co-axial insertion-connected connector and is situated in an opposite position against the sleeve.

16 Claims, 3 Drawing Sheets

U.S. PATENT DOCUMENTS 5,746,623 A * 5/1998 Fuchs et al. ..... 439/578
5,938,465 A * 8/1999 Fox, Sr. ..... 439/350
6,109,964 A * 8/2000 Kooiman ..... 439/583
6,142,812 A * 11/2000 Hwang ..... 439/352
6,645,011 B2 * 11/2003 Schneider et al. ..... 439/609
6,709,289 B2 * 3/2004 Huber et al. ..... 439/578
2003/0027435 A1 * 2/2003 Schneider et al. ..... 439/63

FOREIGN PATENT DOCUMENTS

WO WO 2005027275 A1 * 3/2005

* cited by examiner

COAXIAL INSERTION CONNECTED CONNECTOR HAVING QUICK ACTION LOCKING MECHANISM

This application is a continuation of PCT Application No. PCT/EP2005/010274 filed Sep. 22, 2005, and claims priority from German Application No. DE 20 2004 015 502.8 filed Oct. 6, 2004.

The present invention relates to a co-axial insertion-connected connector having a quick-action locking mechanism, which co-axial insertion-connected connector is designed to receive a complementary insertion-connected connector, the co-axial insertion-connected connector and the complementary co-axial insertion-connected connector being able to be connected together by a coupling member belonging to the quick-action locking mechanism, the co-axial insertion-connected connector and the complementary co-axial insertion-connected connector each having a center-conductor part which forms a center conductor and an outer-conductor part which forms an outer conductor, a contact member being so arranged in the co-axial insertion-connected connector that, when the co-axial insertion-connected connectors are plugged together, the said contact member is arranged between the outer-conductor part of the co-axial insertion-connected connector and the outer-conductor part of the complementary co-axial insertion-connected connector, as specified in the preamble to claim 1.

Known from EP 1337008 A2 is an electrical insertion-connected connector having quick-action locking means, which connector has a first connecting element and a second connecting element which are connected together by a coupling member and form a center conductor and an outer conductor. An outer conductor of the second connecting element makes electrical contact at its leading end, and a resilient contact member is arranged between the first connecting element and the second connecting element. To obtain precisely defined contact with good passive intermediation and low HF emission, the contact member takes the form of an annular disc which bears against the two outer conductors due to axial loading between them and forms continuous areas of contact extending round in a circle.

However, this arrangement has the disadvantage that there is neither a defined plane of contact nor a defined contact zone. This is principally due to the fact that the adjustment of length required for the quick-action locking and the actual making of contact take place at one and the same point. Because of this, the point of contact may be situated in different places and the exact path followed by the current through the outer conductor of the electrical insertion-connected connector is neither pre-determined nor predictable at this point. This detracts to a very considerable degree from the HF characteristics of the insertion-connected connection in question.

The object underlying the invention is to improve an insertion-connected connector of the above kind with regard to the making of contact and HF characteristics.

This object is achieved in accordance with the invention by an insertion-connected connector of the above kind having the features characterized in claim 1. Advantageous embodiments of the invention are described in the other claims.

In a co-axial insertion-connected connector of the above kind, provision is made in accordance with the invention for the contact member to take the form of a sleeve having a first end and a second end, a first end of the sleeve making first electrical contact to give a contact region at the end-face of the outer-conductor part of the complementary co-axial insertion-connected connector and a second end of the sleeve making second electrical contact with the outer-conductor part of the co-axial insertion-connected connector, and for an elastic, electrically non-conductive length-adjusting member to be provided which abuts, by a first side, against the outer-conductor part of the co-axial insertion-connected connector and, by a second side situated in an opposite position, against the sleeve, in a region spaced away from the electrical contacts.

This has the advantage that the function of the making of contact between the outer conductors on the one hand, and the function of the adjusting of length for the quick-action locking on the other hand, are designed to be separated from one another in space. Because of this, the flow of current through the outer-conductor parts of the insertion-connected connection is defined and predictable. This results in the insertion-connected connection having improved HP characteristics.

A maximum adjustment of length in the axial direction is achieved by virtue of the fact that the length-adjusting member is so arranged that, when the co-axial insertion-connected connectors are connected together, it is clamped in place in the axial direction between the sleeve and the outer-conductor part of the co-axial insertion-connected connector.

The length-adjusting member usefully abuts by the first side against a transverse face of the outer-conductor part of the co-axial insertion-connected connector.

The second electrical contact is usefully made in the radial direction between the sleeve and the outer-conductor part of the co-axial insertion-connected connector and, when the co-axial insertion-connected connectors are plugged together, the first electrical contact is made in the axial direction between the sleeve and the outer-conductor part of the complementary co-axial insertion-connected connector.

In a particularly preferred embodiment, the sleeve has, at the first end, a collar which projects in a radically outward direction and, at the second end opposite from the collar, the sleeve is slotted axially so that contact fingers are formed which can be deflected elastically in the radial direction. A recess is preferably formed in the outer-conductor part of the co-axial insertion-connected connector, the second end of the sleeve engaging in the recess and co-operating therewith, at least by the contact fingers, in such a way that, when the co-axial insertion-connected connectors are plugged together, the electrical contact area at the end-face of the outer-conductor part of the complementary co-axial insertion-connected connector abuts against the collar on the sleeve, whereby the first electrical contact, between the outer-conductor part of the complementary co-axial insertion-connected connector and the sleeve on the collar, is made with an area of contact and with a contact-making force which is applied axially by a locking force from the quick-action locking mechanism, and in such a way that, when the co-axial insertion-connected connectors are plugged together, at least one contact finger is deflected elastically in the radial direction and touches and makes contact with the outer-conductor part of the co-axial insertion-connected connector, whereby the second electrical contact, between the outer-conductor part of the co-axial insertion-connected connector and the contact finger of the sleeve, is made with an area of contact and with a contact-making force which is applied radically by the elastic recovery force from the contact finger. An abutment facing towards the collar on the sleeve is usefully formed on the outer-conductor part of the co-axial insertion-connected connector, the length-adjusting member being arranged between the collar on the sleeve and the abutment on the outer-conductor part of the co-axial insertion-connected connector.

The abutment on the outer-conductor part of the co-axial insertion-connected connector is usefully annular in form.

The recess in the outer-conductor part of the co-axial insertion-connected connector is usually open in the radically inward direction towards an insulating part of the center-conductor part of the co-axial insertion-connected connector, thus causing the sleeve to rest against the insulating part of the center-conductor part of the co-axial insertion-connected connector.

To allow secure and reliable electrical contact to be made between the sleeve and the outer-conductor part of the first connector element, the sleeve has, at free ends of the contact fingers, projections which project in the radically outward direction and which abut against an inner surface of the outer-conductor part of the co-axial insertion-connected connector in such a way as to make electrical contact and are of a height such that whichever contact finger is concerned is deflected elastically in the radically inward direction.

The complementary co-axial insertion-connected connector is for example in the form of a co-axial socket or co-axial coupler and the co-axial insertion-connected connector in the form of a co-axial male connector.

The invention will be explained in detail below by reference to the drawings. In the drawings.

Figure 1:
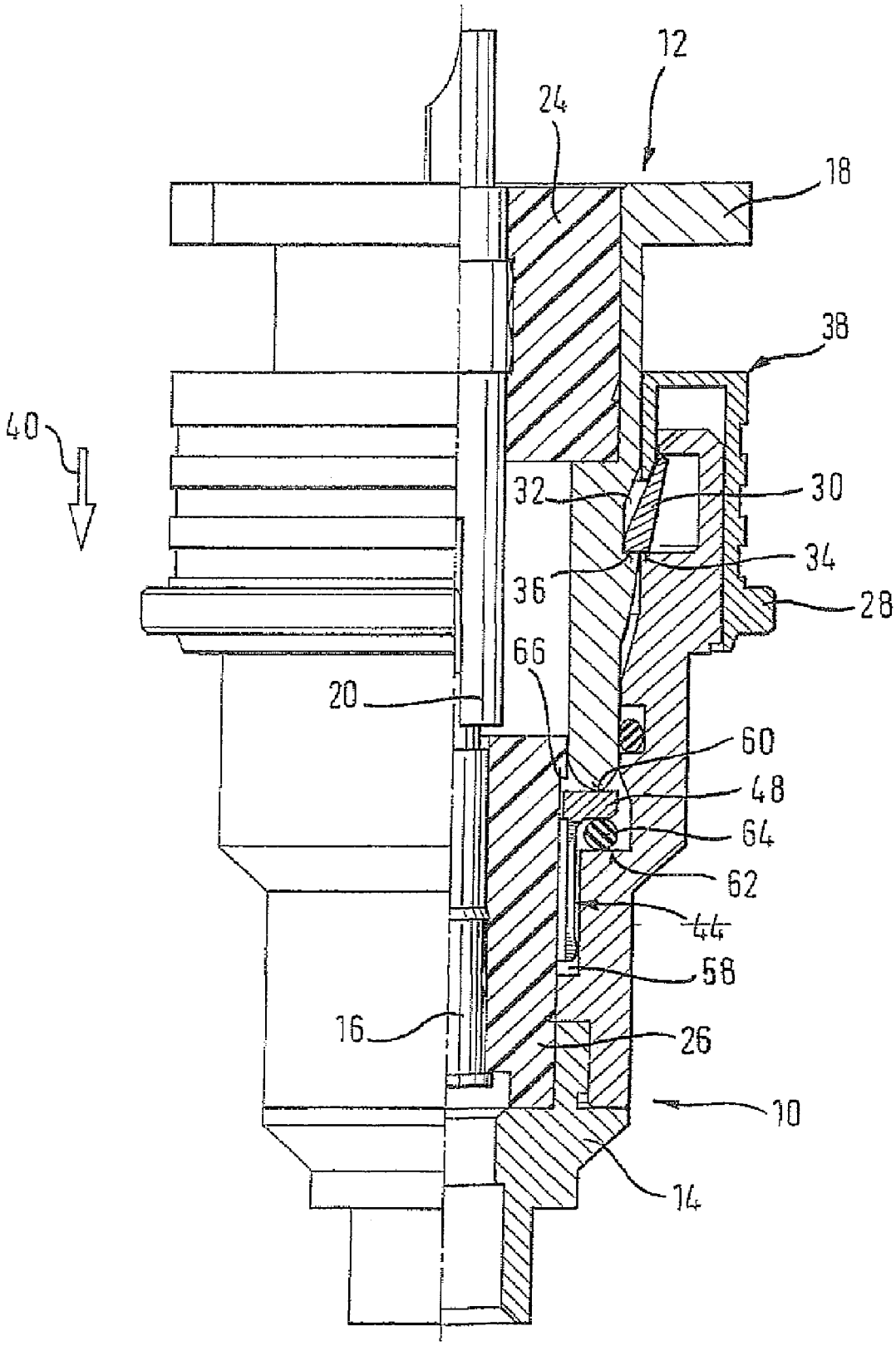
FIG. 1 is a view in section of a preferred embodiment of co-axial insertion-connected connector according to the invention.
Figure 2:
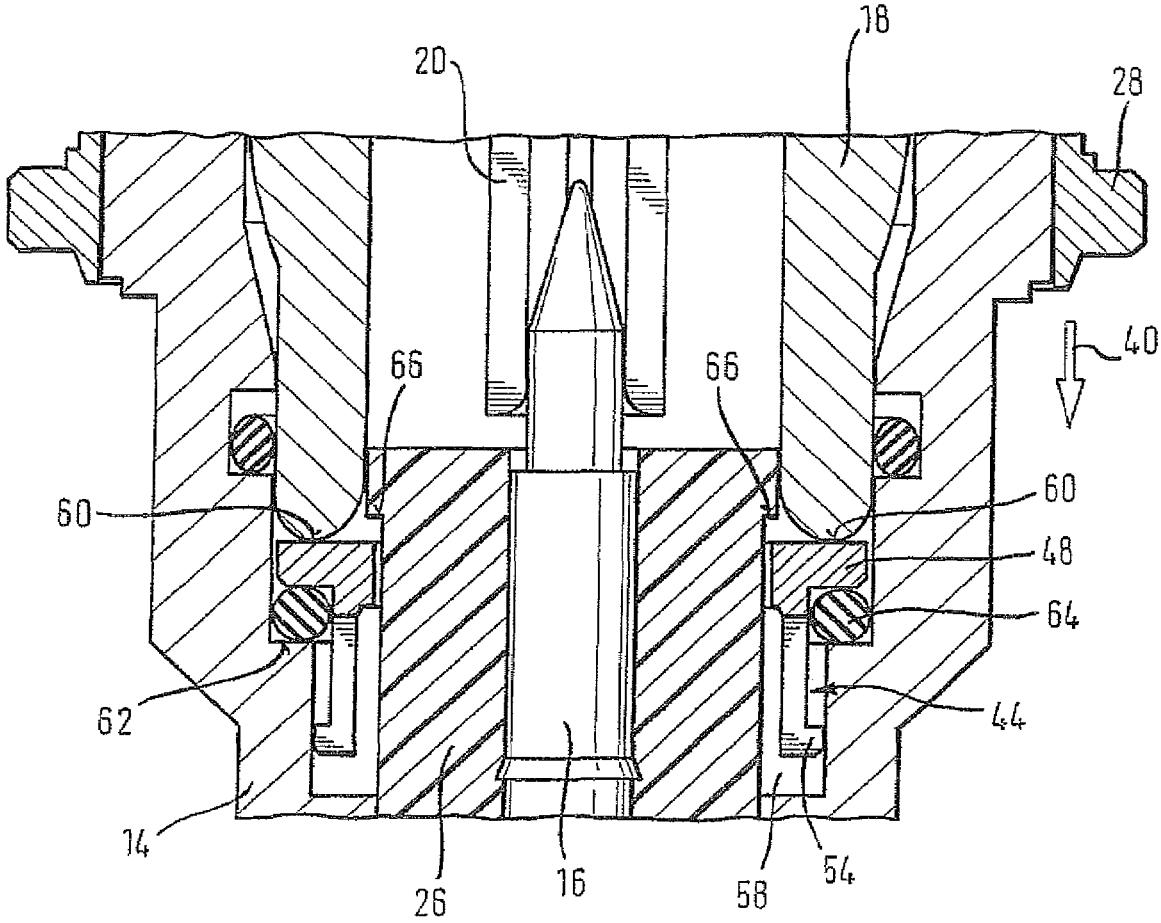
FIG. 2 is a detail view of the contact region of a sleeve of the co-axial insertion-connected connector shown in FIG. 1.

The preferred embodiment of co-axial insertion-connected connector according to the invention which is shown in FIGS. 1 and 2 comprises a first connector element 10 (co-axial insertion-connected connector) in the form of a co-axial male connector, and a second connector element 12 (complementary co-axial insertion-connected connector) in the form of a co-axial coupler. The first connector element 10 comprises an outer-conductor part 14 which forms an outer conductor and a center-conductor part 16 which forms a center conductor. The second connector element 12 comprises an outer-conductor part 18 which forms an outer conductor and a center-conductor part 20 which forms a center conductor. The center-conductor part 16 of the first connector element 10 is surrounded by a first part 26 made of insulating material. A second part 24 made of insulating material is arranged between the outer-conductor part 18 of the second connector element 12 and the inner conductor part 20 of the second connector element 12. The two connector elements 10 and 12 are releasably connected together by a coupling member 28. The coupling member 28 has, in a known fashion, a locking ring 30 which engages in an outer groove 32 in the second connector element 12 and which is positioned against a shoulder 34 on the first connector element 10 and a retaining edge 36. To release the lock, a locking sleeve 38 is moved in the direction of the arrow 40 and thus from above downwards in FIG. 1. By an inner edge which extends round in a circle, the locking ring 30 is lifted out of the outer groove 32 and the lock is thus released. When the two connector elements 10 and 12 are plugged together, the locking ring 30 latches into the groove 32 automatically.

To compensate for the tolerances on the coupling member 28 and to allow good HF characteristics to be obtained, a contact member 44 is provided which is arranged between the outer-conductor part 14 of the first connector element 10 and the outer-conductor part 18 of the second connector element 12. As can be seen from FIG. 3, the contact member 44 is in the form of a sleeve, which sleeve has, at a first end 46, a collar 48 which projects in the radically outward direction and which sleeve, at a second end 50 opposite from the collar 48, is slotted axially, which means that contact fingers 52 able to be deflected elastically in the radial direction are formed. Projections 54 which project in the radically outward direction are formed at the free ends of the contact fingers 52.

The arrangement of the sleeve 44 in the co-axial insertion-connected connector can be seen in detail in FIGS. 1 and 2. By its second end 50, i.e. in essence by the contact fingers 52, the sleeve 44 engages in a recess 58 which is formed in an inner surface of the outer-conductor part 14 of the first connector element 10. In the region of the recess 58, the projections 54 on the sleeve 44 abut against the inner surface of the outer-conductor part 14 of the first connector element 10. The inside diameter of the recess 58 is selected, in this case, to be such that it is smaller than the outside diameter of the sleeve 44 in the region of the projections 54, The result of this is that when the sleeve 44 is slid into the recess 58, the contact fingers 52 are deflected inward elastically in the radial direction. This produces, in the region where the projections 54 are in contact in the recess 58, second electrical contact having an area of contact and having a contact-making force which is applied by the elastic recovery force from the contact fingers 52 which have been deflected inwards elastically in the radial direction. The sleeve 44 is displaceable relative to the outer-conductor part 14 of the connector element 10 in the axial direction. By an edge 66 on the first part 26 made of insulating material, the sleeve 44 is held in position co-axially to the first part 26 made of insulating material and cannot drop out in the axial direction. The sleeve 44 is therefore fitted in the recess 58 in such a way that it cannot be lost, At the first end 46 of the sleeve 44, the collar 48 abuts against an end-face 60 of the outer-conductor part 18 of the second connector element 12. This end-face 60 made an end-face electrical contact. By the coupling member 28 in the form of a quick-action locking mechanism, this end-face 60 is pressed against the collar 48 on the sleeve 44 axially. There is formed in addition, on the outer-conductor part 14 of the first connector element 10, a shoulder 62 which faces towards the collar 48 on the sleeve 44. Between the shoulder 62 and the collar 48 on the sleeve 44 is arranged an elastic length-adjusting member 64. This length-adjusting member 64 is for example in the form of an electrically non-conductive O-ring and, by virtue of its arrangement axially between the collar 48 on the sleeve 44 and the shoulder 62 on the outer-conductor part 14 of the connector element 10, it provides a means of adjusting length in the axial direction in that the length-adjusting member 64 is squashed to a degree of greater or lesser severity in the axial direction. In the axial direction, the locking force of the coupling member 28, which force acts in the axial direction, presses the end-face 60 of the outer-conductor part 18 of the second connector element 12 against the collar 48 and against the opposing elastic deformability of the length-adjusting member 64. By this means, first electrical contact in which there is an area of contact is made between the end-face 60 and the collar 48 by the contact-making force which is applied in the axial direction by the locking force from the coupling member 28.

Figure 3:
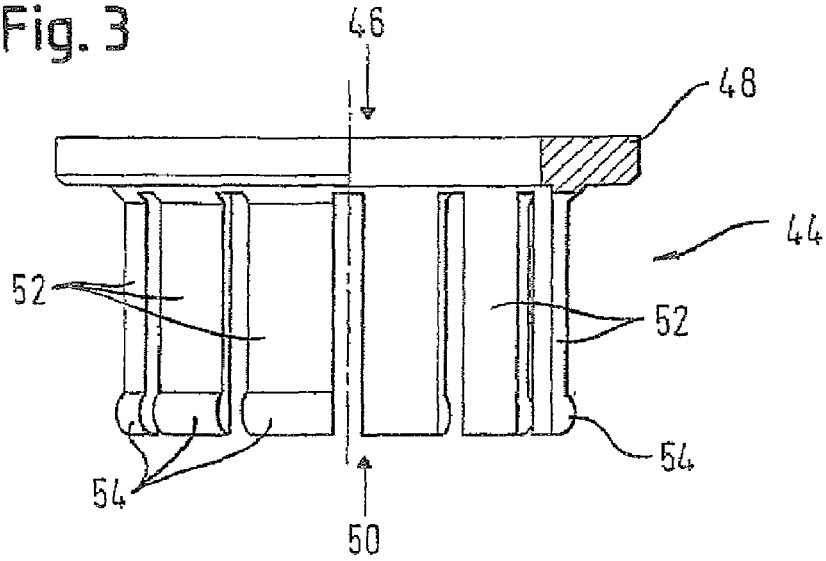
FIG. 3 is a view from the side, partly cut-away, of a sleeve of the co-axial insertion-connected connector shown in FIG. 1.
Figure 4:
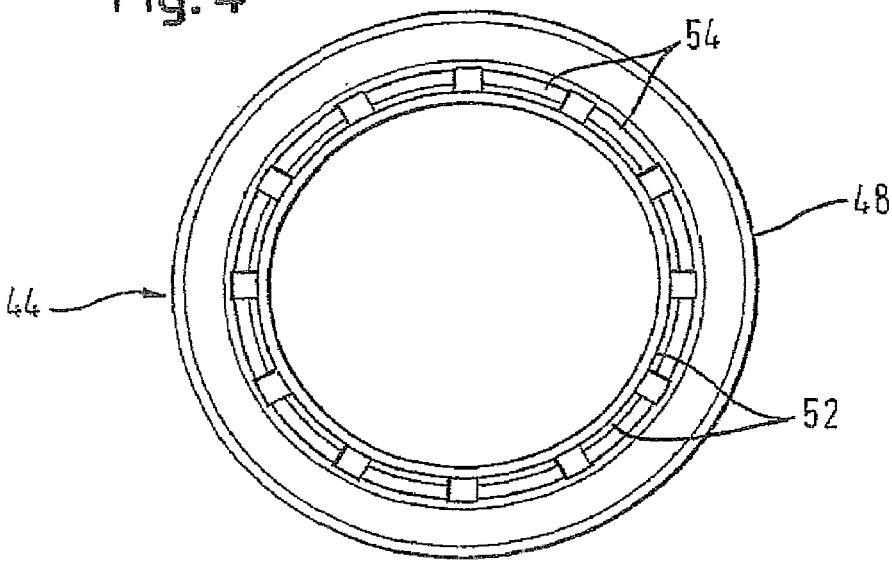
FIG. 4 is a plan view of the sleeve of the co-axial insertion-connected connector shown in FIG. 1.
Figure 5:
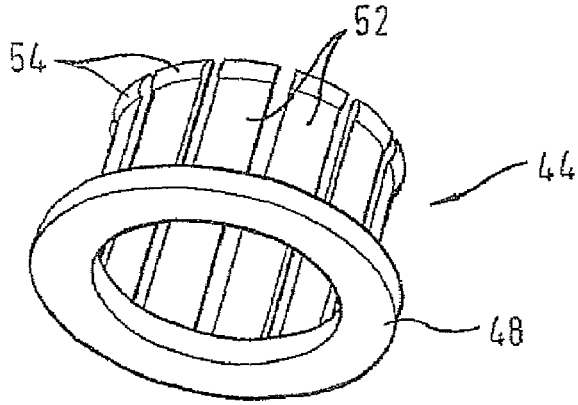
FIG. 5 is a perspective view of the sleeve of the co-axial insertion-connected connector shown in FIG. 1.

The preferred embodiment of the sleeve 44 which is shown in FIGS. 3 to 5 is in the form of a turned part. As an alternative, the sleeve may however also be in the form of what is called a stamped and rolled part, in which case the sleeve 44 may then have a slot which extends for the whole of its axial length.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. Co-axial insertion-connected connector including a quick-action locking mechanism, said co-axial insertion-connected connector designed to receive a complementary insertion-connected connector, the co-axial insertion-connected connector and the complementary co-axial insertion-connected connector being able to be connected together by a coupling member belonging to the quick-action locking mechanism and each including a center-conductor part which forms a center conductor and an outer-conductor part which forms an outer conductor, a contact member being so arranged in the co-axial insertion-connected connector that, when the co-axial insertion-connected connectors are plugged together, said contact member is separate from, slideably connected to, and secured by, the outer-conductor part of the co-axial insertion-connected connector, and arranged between the outer-conductor part of the co-axial insertion-connected connector and the outer-conductor part of the complementary co-axial insertion-connected connector, characterized in that the contact member takes the form of a sleeve having a first end and a second end, the first end of the sleeve making first, axial electrical contact to give a contact region at the end-face of the outer-conductor part of the complementary co-axial insertion-connected connector, such that said outer-conductor part of the complementary co-axial insertion-connected connector provides an axial force to the sleeve first end, and the second end of the sleeve making second, radial electrical contact with the outer-conductor part of the co-axial insertion-connected connector, and in that an elastic length-adjusting member is provided which abuts, by a first side, against the outer-conductor part of the co-axial insertion-connected connector and, by a second side situated in an opposite position, against the sleeve first end, electrically separating the sleeve first end from the outer-conductor part of the co-axial insertion-connected connector.

2. The co-axial insertion-connected connector of claim 1 including having said length-adjusting member arranged such that when the co-axial insertion-connected connectors are connected together, said length-adjusting member is clamped in place in axial direction between the sleeve and the outer-conductor part of the co-axial insertion-connected connector.

3. The co-axial insertion-connected connector of claim 1 including having said length-adjusting member abut by the first side against a transverse face of the outer-conductor part of the co-axial insertion-connected connector.

4. The co-axial insertion-connected connector of claim 1 including having the co-axial insertion-connected connectors plugged together such that the first electrical contact is made in the axial direction between the sleeve and the outer-conductor part of the complementary co-axial insertion-connected connector.

5. The co-axial insertion-connected connector of claim 1 wherein the sleeve includes, at the first end, a collar which projects in a radially outward direction and, at the second end opposite from the collar, the sleeve includes axial slots so that contact fingers are formed which can be deflected elastically in the radial direction.

6. The co-axial insertion-connected connector of claim 5 comprising a recess formed in the outer-conductor part of the co-axial insertion-connected connector, the second end of the sleeve engaging in the recess and co-operating therewith, at least by the contact fingers, such that, when the co-axial insertion-connected connectors are plugged together, the electrical contact area at the end-face of the outer-conductor part of the complementary co-axial insertion-connected connector abuts against the collar on the sleeve, whereby the first electrical contact, between the outer-conductor part of the complementary co-axial insertion-connected connector and the sleeve on the collar, is made with an area of contact and with a contact-making force which is applied axially by a locking force from the quick-action locking mechanism, and in such a way that, when the co-axial insertion-connected connectors are plugged together, at least one contact finger is deflected elastically in the radial direction and touches and makes contact with the outer-conductor part of the co-axial insertion-connected connector, whereby the second electrical contact, between the outer-conductor part of the co-axial insertion-connected connector and the contact finger of the sleeve, is made with an area of contact and with a contact-making force which is applied radially by the elastic recovery force from the contact finger.

7. The co-axial insertion-connected connector of claim 6 including having an abutment facing towards the collar on the sleeve, formed on the outer-conductor part of the co-axial insertion-connected connector, the length-adjusting member being arranged between the collar on the sleeve and the abutment on the outer-conductor part of the co-axial insertion-connected connector.

8. The co-axial insertion-connected connector of claim 7 including having the abutment on the outer-conductor part of the co-axial insertion-connected connector is annular in form.

9. The co-axial insertion-connected connector of claim 6 including having the recess in the outer-conductor part of the co-axial insertion-connected connector open in the radially inward direction towards an insulating part of the center-conductor part of the co-axial insertion-connected connector, causing the sleeve to enclose the insulating part of the center-conductor part of the co-axial insertion-connected connector.

10. The co-axial insertion-connected connector of claim 5 including the sleeve having, at free ends of the contact fingers, projections which project in the radially outward direction and which abut against an inner surface of the outer-conductor part of the co-axial insertion-connected connector in such a way as to make electrical contact and having a height such that whichever contact finger is concerned is deflected elastically in the radially inward direction.

11. The co-axial insertion-connected connector of claim 1, including having the complementary co-axial insertion-connected connector in the form of a co-axial socket or co-axial coupler and including having the co-axial insertion-connected connector in the form of a co-axial male connector.

12. The co-axial insertion-connected connector of claim 2 including having the co-axial insertion-connected connectors plugged together such that the first electrical contact is made in the axial direction between the sleeve and the outer-conductor part of the complementary co-axial insertion-connected connector.

13. The co-axial insertion-connected connector of claim 1 wherein the sleeve includes, at the first end, a collar which projects in a radially outward direction and, at the second end opposite from the collar, the sleeve includes axial slots so that contact fingers are formed which can be deflected elastically in the radial direction.

14. The co-axial insertion-connected connector of claim 8 including having the recess in the outer-conductor part of the co-axial insertion-connected connector open in the radially inward direction towards an insulating part of the center-conductor part of the co-axial insertion-connected connector, causing the sleeve to enclose the insulating part of the center-conductor part of the co-axial insertion-connected connector.

15. The co-axial insertion-connected connector of claim 9 including the sleeve having, at free ends of the contact fingers, projections which project in the radially outward direction and which abut against an inner surface of the outer-conductor part of the co-axial insertion-connected connector in such a way as to make electrical contact and having a height such that whichever contact finger is concerned is deflected elastically in the radially inward direction.

16. The co-axial insertion-connected connector of claim 10, including having the complementary co-axial insertion-connected connector in the form of a co-axial socket or co-axial coupler and including having the co-axial insertion-connected connector in the form of a co-axial male connector.

* * * * *

UNITED STATES PATENT AND TRADEMARK OFFICE

CERTIFICATE OF CORRECTION

PATENT NO. : 7,510,432 B2
APPLICATION NO. : 11/692999
DATED : March 31, 2009
INVENTOR(S) : Christian Entsfellner It is certified that error appears in the above-identified patent and that said Letters Patent is hereby corrected as shown below:

In the Specification:

Column 3, line 13, delete "radically" and substitute therefore -- radially --

Column 3, line 18, delete "radically" and substitute therefore -- radially --

Column 4, line 8, delete "radically" and substitute therefore -- radially --

Column 4, line 13, delete "radically" and substitute therefore -- radially --

Signed and Sealed this

Eleventh Day of August, 2009

David J. Kappos

David J. Kappos
*Director of the United States Patent and Trademark Office*